US010631628B1

(12) United States Patent
Montford

(10) Patent No.: US 10,631,628 B1
(45) Date of Patent: Apr. 28, 2020

(54) PAINT BRUSH EXTENSION MECHANISM

(71) Applicant: John Montford, Lake Wales, FL (US)

(72) Inventor: John Montford, Lake Wales, FL (US)

( * ) Notice: Subject to any disclaimer, the term of this patent is extended or adjusted under 35 U.S.C. 154(b) by 0 days.

(21) Appl. No.: 15/628,603

(22) Filed: Jun. 20, 2017

Related U.S. Application Data

(60) Provisional application No. 62/352,084, filed on Jun. 20, 2016.

(51) Int. Cl.

| | |
|---|---|
| ***A46B 17/02*** | (2006.01) |
| ***A46B 5/00*** | (2006.01) |
| ***B25G 3/22*** | (2006.01) |
| ***B25G 3/20*** | (2006.01) |
| ***B25G 3/30*** | (2006.01) |
| ***B25G 3/38*** | (2006.01) |
| ***B25G 3/12*** | (2006.01) |

(52) U.S. Cl.
CPC ..... *A46B 17/02* (2013.01); *A46B 5/0054* (2013.01); *A46B 5/0058* (2013.01); *A46B 5/0075* (2013.01); *A46B 5/0083* (2013.01); *A46B 5/0095* (2013.01); *B25G 3/12* (2013.01); *B25G 3/20* (2013.01); *B25G 3/22* (2013.01); *B25G 3/30* (2013.01); *B25G 3/38* (2013.01); *A46B 2200/202* (2013.01)

(58) Field of Classification Search
CPC ..... A46B 5/00; A46B 5/002; A46B 5/0054; A46B 5/0058; A46B 5/0075; A46B 5/0079; A46B 5/0083; A46B 5/0095; A46B 7/00; A46B 7/02; A46B 7/04; A46B 7/046; A46B 7/048; A46B 15/00; A46B 17/02; A46B 2200/202; A46B 2200/205; B25G 1/00; B25G 1/04; B25G 1/06; B25G 3/12; B25G 3/20; B25G 3/22; B25G 3/24; B25G 3/26; B25G 3/30; B25G 3/32; B25G 3/36; B25G 3/38; Y10S 16/24; Y10S 16/25; Y10S 16/41; Y10T 16/469; Y10T 16/4713; Y10T 16/4719; Y10T 16/473; Y10T 16/498
USPC ..... 15/144.1–144.4, 145, 146, 172, 15/176.1–176.6; 16/422, 426, 427, 429, 16/436, 900, DIG. 24, DIG. 25, DIG. 41
See application file for complete search history.

(56) References Cited

U.S. PATENT DOCUMENTS

| | | | | | |
|---|---|---|---|---|---|
| 239,660 | A * | 4/1881 | Hurlburt | ..... | 15/146 |
| 3,336,617 | A * | 8/1967 | Bosko | ..... | B44D 3/12 15/146 |
| 3,413,043 | A * | 11/1968 | Bertolina | ..... | A46B 17/02 15/144.1 |
| 3,984,892 | A * | 10/1976 | Kyriakou | ..... | A46B 17/02 15/111 |
| 6,473,929 | B1 * | 11/2002 | Learned, III | ..... | A46B 5/02 15/143.1 |

(Continued)

FOREIGN PATENT DOCUMENTS

| | | | |
|---|---|---|---|
| GB | 651683 | * | 4/1951 |
| WO | 98/08419 | * | 3/1998 |

*Primary Examiner* — Mark Spisich
(74) *Attorney, Agent, or Firm* — Michael J. Bootcheck, LLC; Michael J. Bootcheck

(57) ABSTRACT

This invention is generally directed to a paint brush extension mechanism. More specifically, the invention relates to a system that may engage a variety of variously sized paint brushes so as to affix an extension rod to allow a user to "cut-in" to hard to paint areas such as the ceiling line, corners, and along baseboards and trim.

4 Claims, 9 Drawing Sheets

(56) References Cited

U.S. PATENT DOCUMENTS

| | | | | |
|---|---|---|---|---|
| 8,566,999 | B1 * | 10/2013 | Casey | A46B 5/0083 15/146 |
| 8,651,047 | B1 * | 2/2014 | Uri | A46B 5/0045 118/504 |
| 2005/0039281 | A1 * | 2/2005 | Lougheed | A46B 5/0075 15/172 |
| 2006/0207044 | A1 * | 9/2006 | Ridgway | A46B 5/0091 15/146 |
| 2008/0276396 | A1 * | 11/2008 | Lucero | A46B 5/0083 15/144.2 |

* cited by examiner

PAINT BRUSH EXTENSION MECHANISM

CROSS-REFERENCE TO RELATED APPLICATIONS

This application claims priority from U.S. Provisional Application Ser. No. 62/352,084 filed 20 Jun. 2016, which is titled "PAINT BRUSH EXTENSION MECHANISM", which is hereby incorporated in its entirety by reference.

FIELD OF THE INVENTION

This invention is generally directed to a paint brush extension mechanism. More specifically, the invention relates to a fastener that may engage a variety of variously sized paint brushes so as to affix an extension rod to allow a user to "cut-in" to hard to paint areas such as the ceiling line, corners, and along molding, baseboards and trim.

BACKGROUND OF THE INVENTION

Paint is typically applied to walls, floors, ceilings and so forth utilizing tools well known in the art known as a rollers and brushes. Using a roller is the easiest and fastest method to paint large, clear, uninterrupted areas. However, when painting the ceiling, it is very difficult to prevent the brush or roller from touching the adjacent surface near the seam or joint with the ceiling/wall thereby causing paint to go on the adjacent surface.

Likewise, when painting the upper parts of walls, it is very difficult to prevent the brush or roller from touching the ceiling, at the seam or joint with the wall thereby causing paint to go on the ceiling.

In order to prevent this type of damage it is possible to "mask" the adjoining area with masking tape. This method cannot be used if the surface to be masked has been recently painted. It is also not practical if the adjoining surface has a covering of a mural or a tapestry or wallpaper. In addition, placing the masking tape adds to the cost of labor, as such additional and time-consuming protective work is required in order to complete the work satisfactorily.

For this reason, normal practice is to carry out ceiling painting in two stages. Firstly, a line is carefully painted at the intersection with the wall or trim, this is done with a narrower brush. Then the larger uninterrupted areas are painted with a roller or wider brush in the second stage of painting.

This present system of painting ceilings and the upper parts of walls requires the use of ladders or the erection of scaffolds.

This presents a number of problems:

A: The furniture has to be moved away from the wall in order to allow for the erection of a scaffold, or for the placing of ladders near the edge of the room. This work often takes two people to do and uses manpower which could be more efficiently utilized.

B: Having finished one section with a brush and then being ready to move to the next, it is necessary to move the ladder. This entails climbing down the ladder, taking all the painting equipment and paint down at the same time and then moving the ladder to the new location and then climbing up the ladder again, bringing up also all the equipment, and paint, etc. It is usual to bring equipment down, each time to prevent damage from paint spillage. Another option could be for the painter to remain at the top of the ladder and with his legs, move the ladder to the next place to be painted. This can be a dangerous process for all but the most experienced, as the ladder is unstable when this is being done, thereby risking the ladder toppling over, together with the painter and the paint pot.

C: Light fittings are usually on the ceiling or on the upper part of walls requiring the painter to work carefully around each fitting.

D: The work itself is then carried out in two stages, first using small brushes for the edging and detail, and then later, a roller or a wide brush for the larger unobstructed areas.

E: This process is normally carried out at least twice, as two coats of paint are usually applied.

F: In some rooms, for example bathrooms, there are immovable obstructions on the door which prevent the possibility of the placement of the ladder in a convenient position for work.

Additionally, when painting the lower parts of walls, it is very difficult to prevent the brush or roller from also painting the floor, at the joint with the wall. Also, this kind of painting requires the painter to work bent over or crouching down, both of which are undesirable positions for careful and accurate paint work.

Another difficulty which often presents itself, especially when painting ceilings, is that paint drips on to the floor. Paint dripping on the floor causes damage.

There is therefore a need for a system and method of painting one surface, up to the edge of an adjacent surface without touching the latter surface with the painting tool especially when painting surfaces that are hard to reach like ceilings. There is a need for the tool to be versatile in its ability to be adjustable to allow a wide variety of paint brushes to be attached and in its ability to work in a wide variety of work situations.

SUMMARY OF THE INVENTION

It is to be understood that both the foregoing general description and the following detailed description present embodiments of the invention, and are intended to provide an overview, or framework, for understanding the nature and character of the invention as it is claimed. The accompanying drawings are included to provide a further understanding of the invention, and are incorporated into and constitute part of this specification. The drawings illustrate various embodiments of the invention and, together with the description serve to explain the principles and operations of the invention.

The invention can hold a brush firmly at the end of a pole so that a painter can paint distant objects like ceilings, which are otherwise not reachable without a ladder or other apparatus.

The invention is securedly attachable to a pole and fits any size brush and the brush is held firmly in the brush holder and, thus, on the pole and yet is removable with ease.

This invention makes it easier for both professional painters and novices alike, to paint, using a variety of different sized brushes, to reach areas which are out of normal reach, without the need to erect and stand on scaffolds or ladders. When standing on a ladder, the painter can only paint the area he can reach from his position. This invention will enable him to save time and money by enabling him to do the same or better work without a ladder.

The invention is for painters to stand safely on the floor, without incurring any risk of falling from a height. This also applies to difficult places for painting like stair cases and stair wells or the eaves under a roof.

This invention also saves the time required to move items of furniture which would otherwise have to be moved in order to allow a ladder or scaffold to be erected. It uses simple mechanical means which will help reduce manufacturing costs and hence make the device marketable to a wider population.

These and other features and advantages of the present invention will become apparent after a review of the following detailed description of the disclosed embodiment and the appended figures and claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Figure 1:
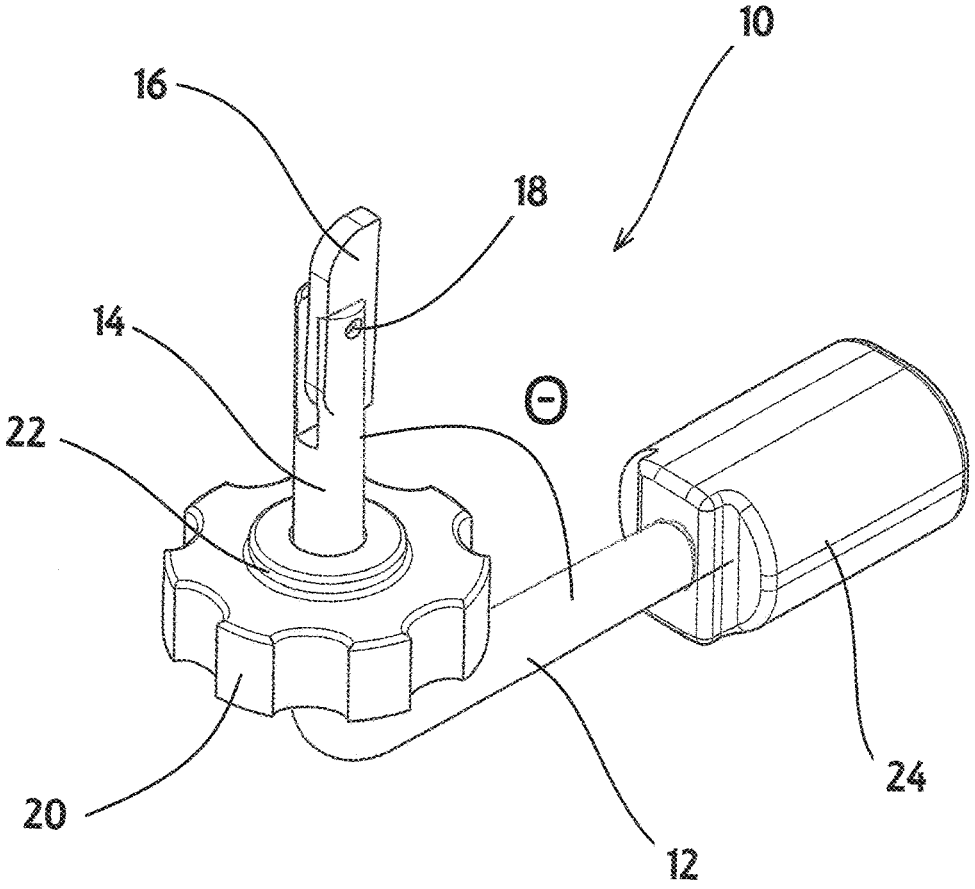
FIG. 1 illustrates a perspective view of an exemplary embodiment of the present invention.

FIG. 1 illustrates a perspective view of an exemplary embodiment of the present invention. Illustrated is brush holder 10, first shaft 12, second shaft 14, restraining member 16, pivot pin 18, restraining knob 20, spacer 22, and extension coupler 24. When restraining member 16 is in the condition shown, a paint brush may be threaded over member 16 and onto second shaft 14. After the brush passes member 16, it can be rotated about pin 18 and then knob 20 can be rotated about second shaft 14 such that knob 20 advances toward restraining member 16 until the paint brush becomes secured between them. Note that the paint brush may be locked into any rotational position. Note that angle Θ may be any angle and is approximately 90 degrees it this embodiment. Note that shafts 12, 14 may be unitary or of any suitable number of components. Note that the spacer is optional and may be of any dimensions, shape, etc.

Figure 2:
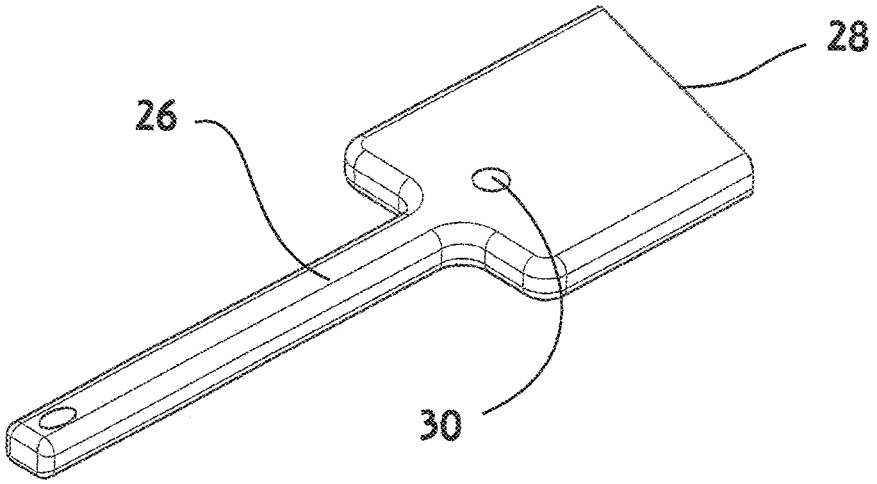
FIG. 2 illustrates a perspective view of an exemplary embodiment paint brush.

FIG. 2 illustrates a perspective view of an exemplary embodiment paint brush 25. Illustrated is a paint brush having handle 26, bristles 28, and brush hole/slot 30.

Figure 3:
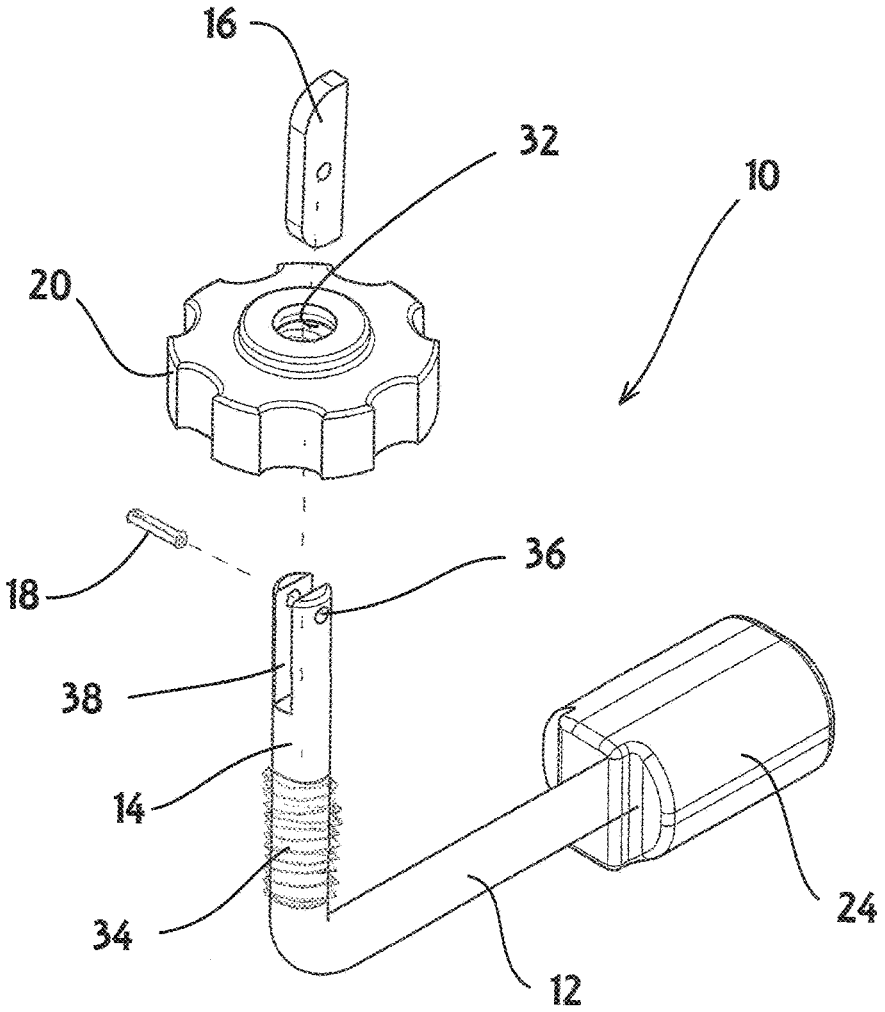
FIG. 3 illustrates an exploded perspective view of an exemplary embodiment of the present invention.

FIG. 3 illustrates an exploded perspective view of an exemplary embodiment of the present invention. Illustrated is brush holder 10, first shaft 12, second shaft 14, restraining member 16, pivot pin 18, restraining knob 20, spacer 22, extension coupler 24, knob threads 32, shaft threads 34, pin slots 36, and restraining member slot 38. When restraining member 16 is in the condition shown, a paint brush may be threaded over member 16 and onto second shaft 14.

Figure 4:
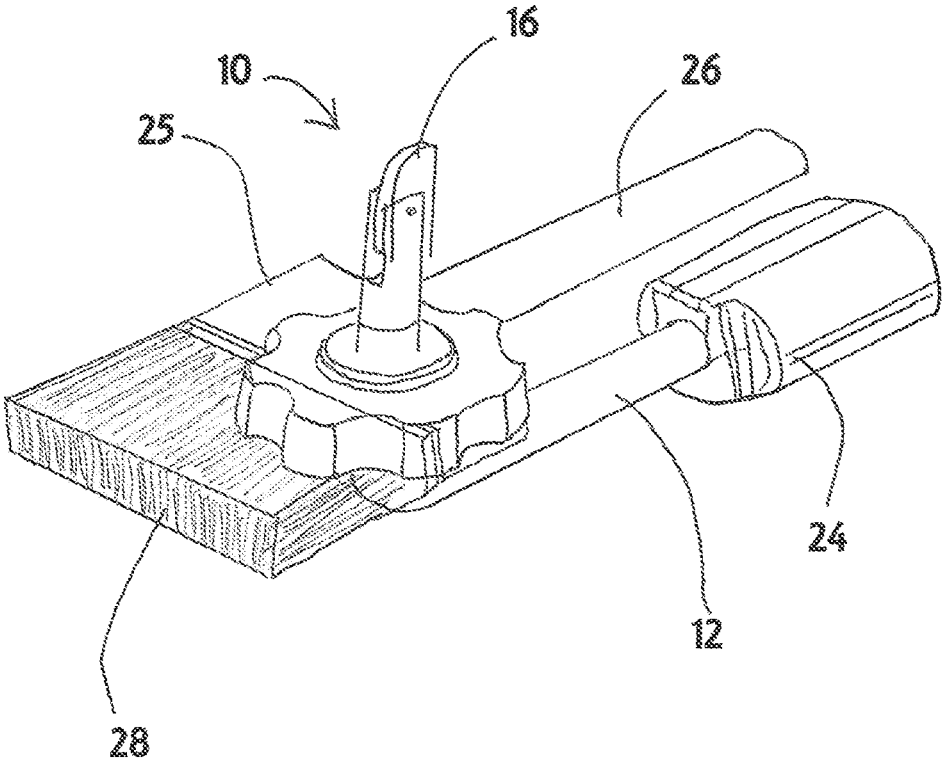
FIG. 4 illustrates a perspective view of an exemplary embodiment of the present invention brush holder and paint brush.

FIG. 4 illustrates a perspective view of an exemplary embodiment of the present invention brush holder and paint brush. Illustrated is brush holder 10, first shaft 12, second shaft 14, restraining member 16, pivot pin 18, restraining knob 20, spacer 22, extension coupler 24, paint brush 25, handle 26, and bristles 28.

Figure 5:
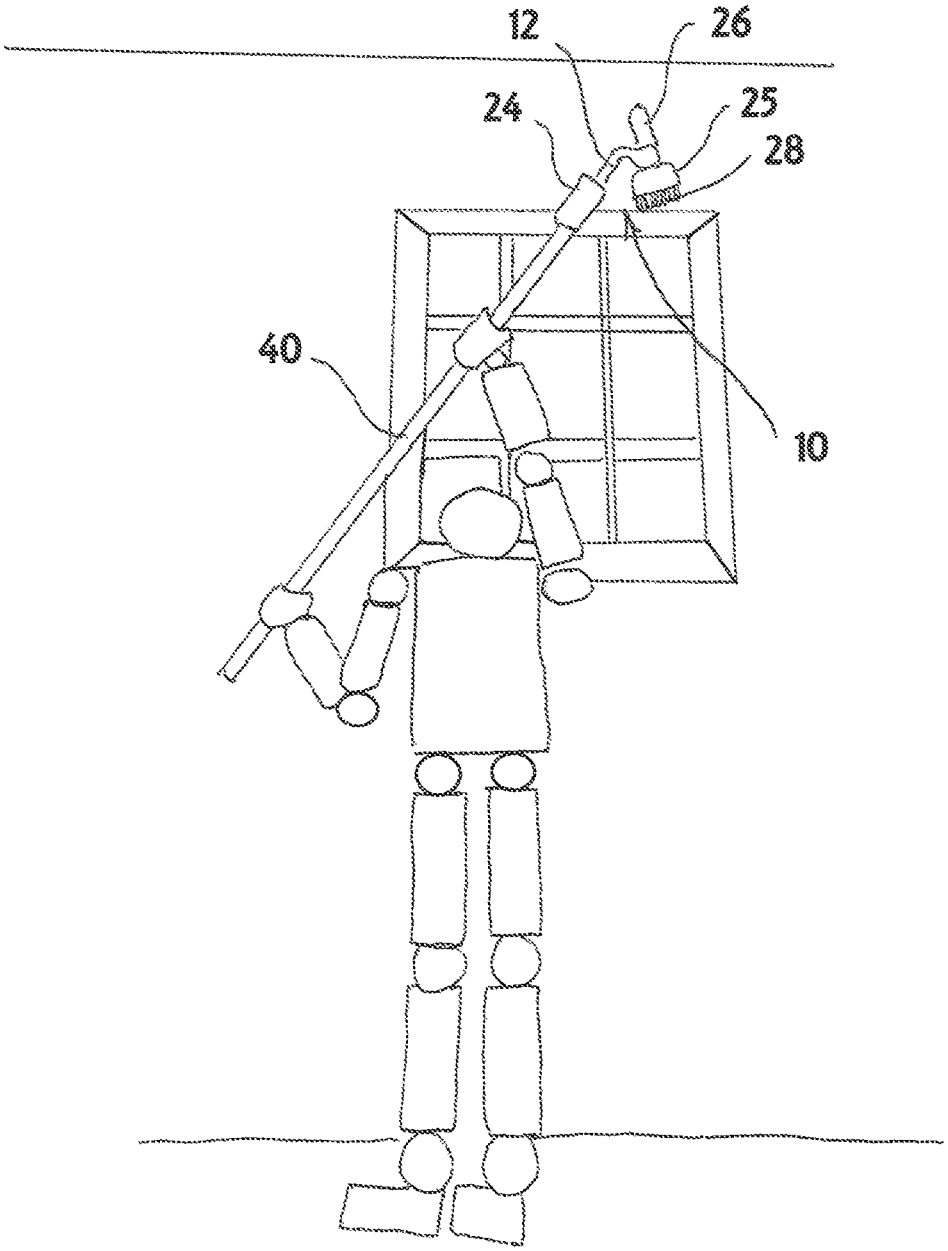
FIG. 5 illustrates a perspective view of an exemplary embodiment of the present invention in use in an exemplary environment.

FIG. 5 illustrates a perspective view of an exemplary embodiment of the present invention in use in an exemplary environment. Illustrated are brush holder 10, first shaft 12, paint brush 25, handle 26, bristles 28, and pole 40. Note that extension coupler 24 may have interior threads which mate/cooperate with exterior threads on a pole although other means of mating brush holder 10 to a pole 40 may be utilized.

Figure 6:
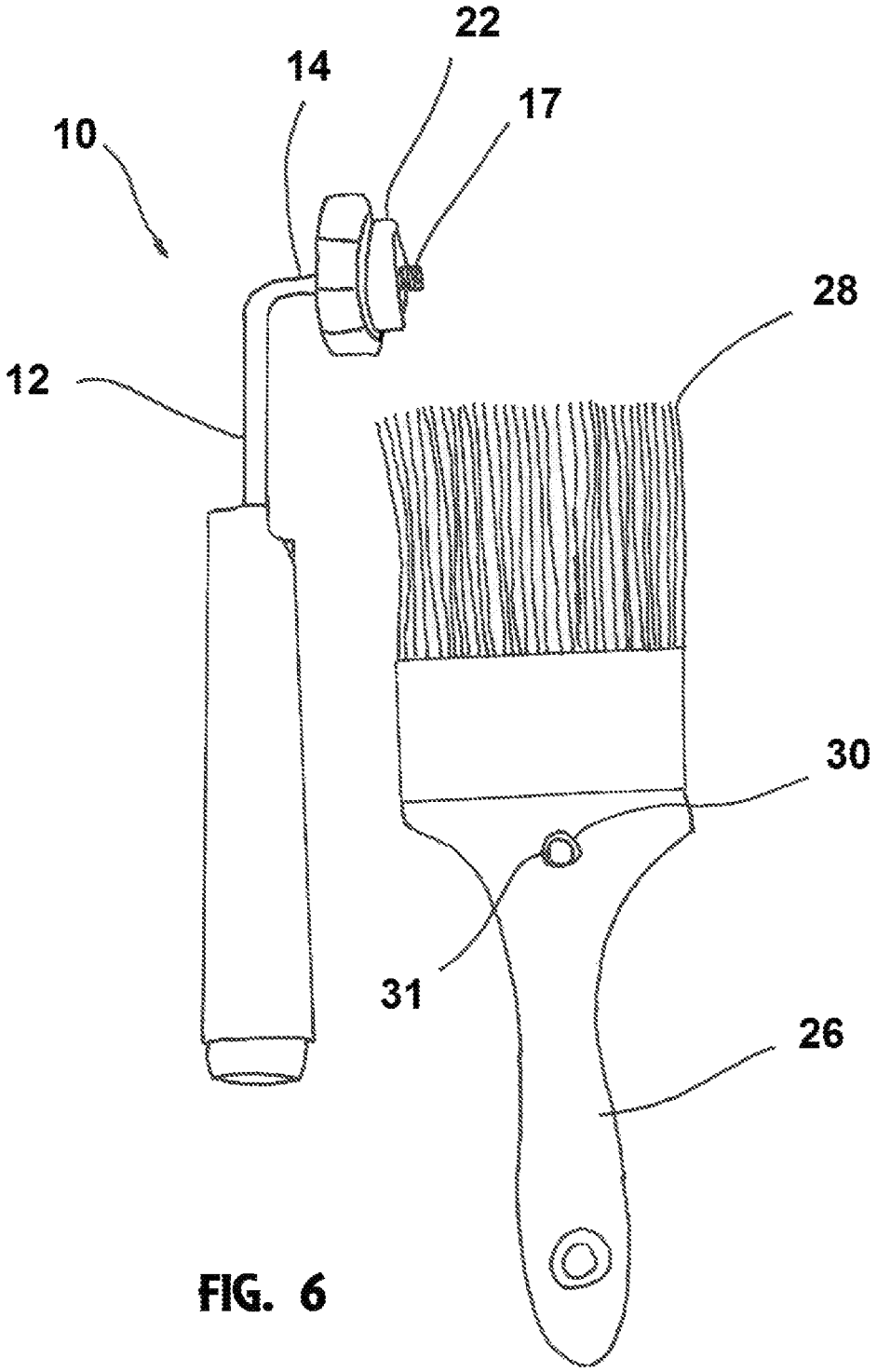
FIG. 6 illustrates a front view of another exemplary embodiment of the present invention in a disassembled condition.
Figure 7:
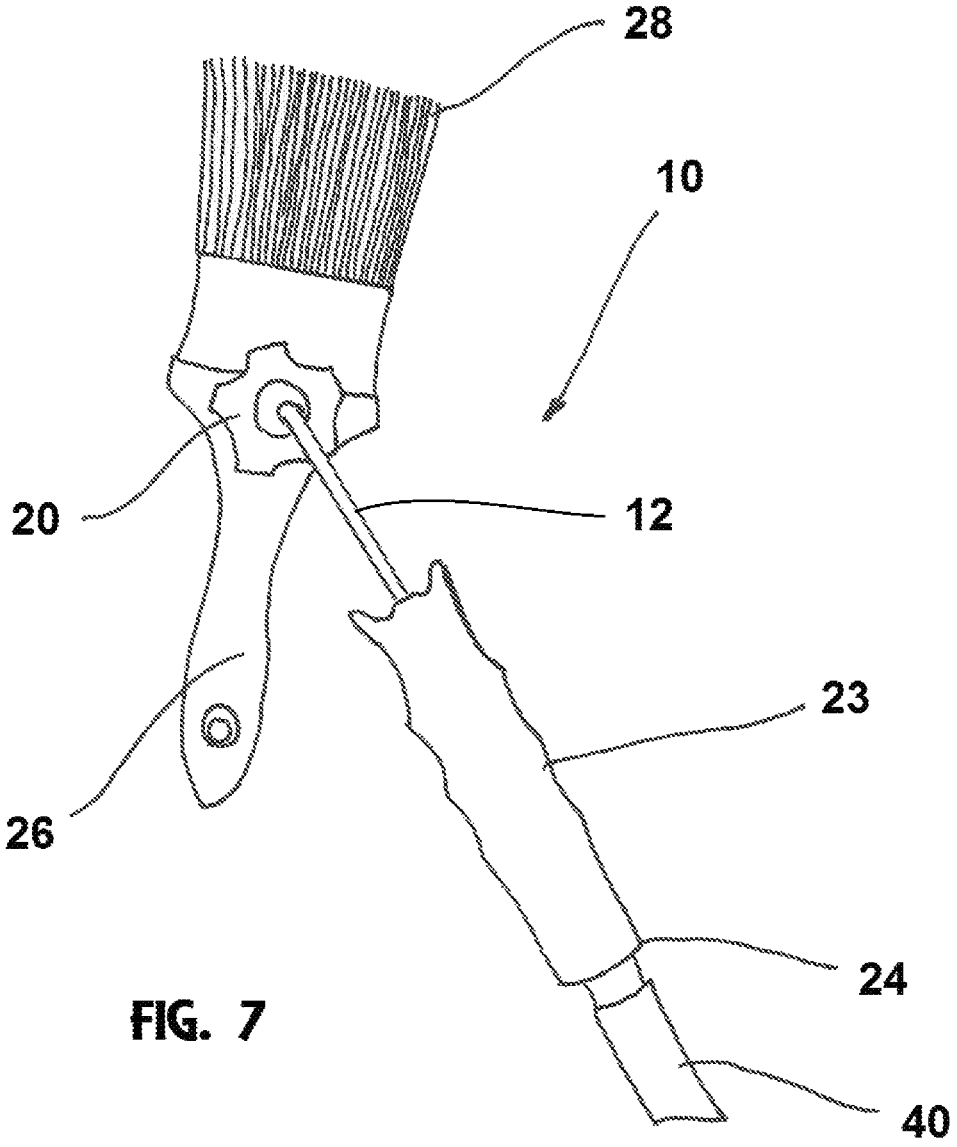
FIG. 7 illustrates a side view of the exemplary embodiment of FIG. 6 in an installed condition on an extension pole.
Figure 10:
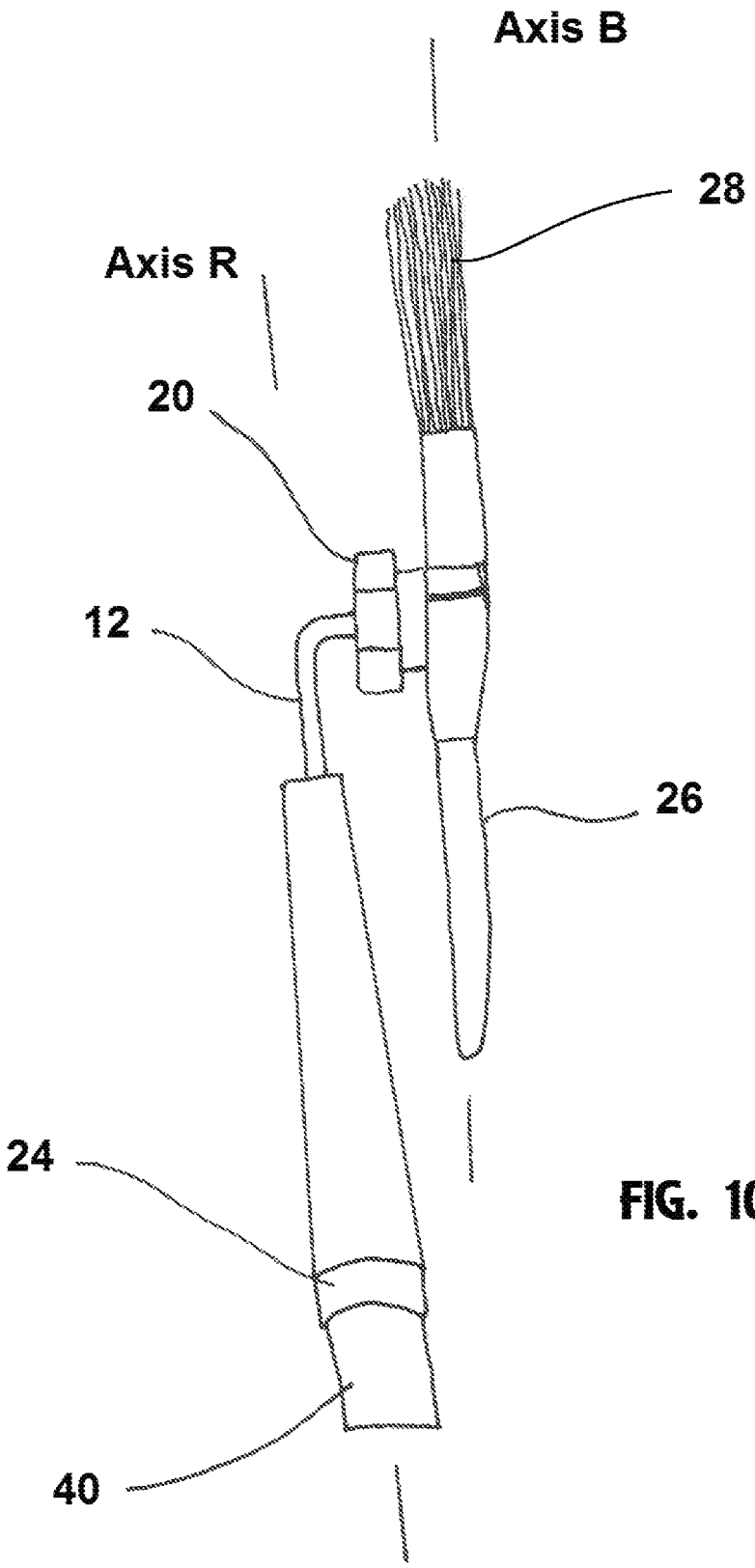
FIG. 10 illustrates a front view of an exemplary embodiment of the present invention.

FIG. 6 illustrates a front view of another exemplary embodiment of the present invention in a disassembled condition. Illustrated is brush holder 10, first shaft 12, second shaft 14, threaded shaft 17, restraining knob 20, spacer 22, extension coupler 24, brush handle 26, bristles 28, hole 30 with threaded portion 31. In this embodiment, shaft 14 has external threads 17 which allow the two separate members, knob 20 and/or spacer 22 as well as the internal threads 31 of handle 26 to be mated such that the internal threads 17 and 31 fit about the external threads 17. Note that the internal threaded portion 31 of handle 26 may be unitary with the handle or a separate component which is connected to the handle. Further, the hole/threads of the handle do not necessarily have to penetrate completely through the handle. In an exemplary use, the handle and its threads may be fit about shaft 14/threads 17 and the handle "screwed" onto the shaft. After at least partially screwing on the handle portion, the knob/spacer may be rotated/tightened down against the handle such that the user may select the desired angle of the brush and then set the angle via the use of the knob. This system will allow the user to choose any desired angle between 0° and 360° when measured relative to the angle of a central axis of shaft 12 (Axis R in FIG. 10)(note that FIG. 7 illustrates this angle wherein the brush portion can be rotated about shaft 14 and then locked into position via knob 20. Axis B of FIG. 10 illustrates the brush central axis. Note that Axis R and Axis B are never co-planar due to shaft 14 being at an angle with shaft 12. In the illustrated embodiment, shaft 14 is perpendicular to shaft 12 and, in such an embodiment, Axis B is parallel to Axis R.

Note that although knob 20 is illustrated in this embodiment as being on the shaft 12 side of the brush, the knob could also be placed on the opposite side of the brush. In such a configuration, the brush could be screwed only shaft 14 first, and then knob 20 could be screwed onto shaft 14 to lock the relationship of the brush to shaft 12/14 into position.

As mentioned above, the paint brush may be locked into any rotational position. Note that angle Θ may be any angle and is approximately 90 degrees it this embodiment. Note that shafts 12, 14 may be unitary or of any suitable number of components/parts.

FIG. 7 illustrates a side view of the exemplary embodiment of FIG. 6 in an installed condition on an extension pole (a portion of pole 40 is shown). Illustrated is are many of the components of FIG. 6 are shown and also shown is handle/gripping section 23, a portion of rod 40, etc.

Figure 8:
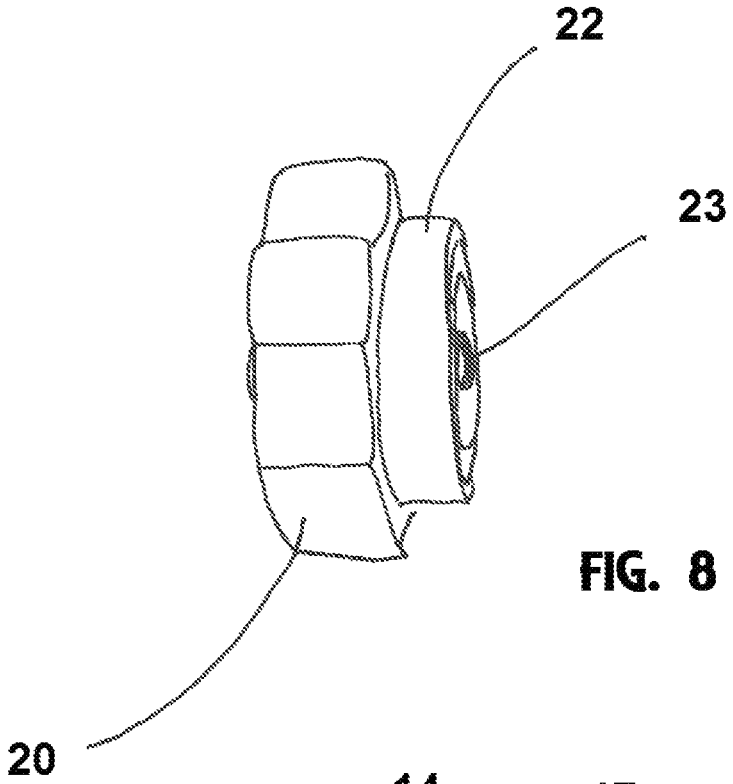
FIG. 8 illustrates a knob portion of an exemplary embodiment of the present invention.

FIG. 8 illustrates a knob portion of an exemplary embodiment of the present invention. Illustrated is knob 20, spacer 22 and threads 32 (which may fit about shaft 14's threads 17).

Figure 9:
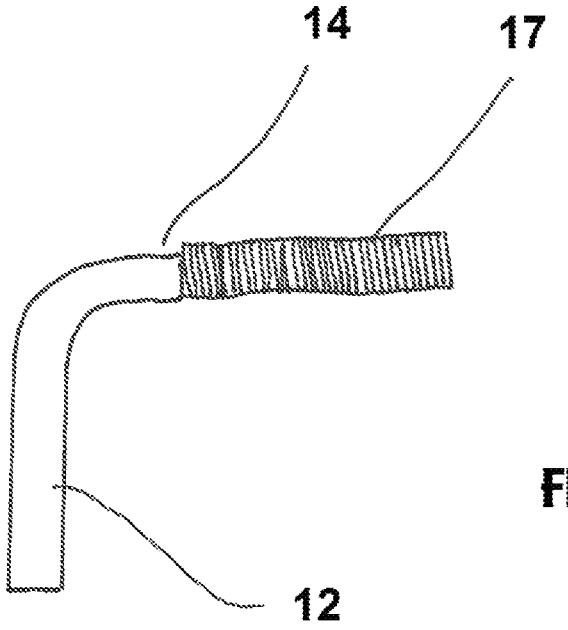
FIG. 9 illustrates a shaft portion and threaded portion of an exemplary portion of an exemplary embodiment of the present invention.

FIG. 9 illustrates a shaft portion and threaded portion of an exemplary portion of an exemplary embodiment of the present invention. Illustrated are shaft 12, shaft 14 and threads 17. In this embodiment, Θ is 90°, though Θ may be of any desired angle.

FIG. 10 illustrates a front view of an exemplary embodiment of the present invention. Shown are various components of the exemplary embodiment and axis R and B as described above, the axis of rod 40/shaft 12 and the axis of the brush portion respectively.

Although various components of the present invention may be illustrated as being of a particular shape for convenience, such components may be of any suitable shape, configuration, orientation, etc.

While the specification has been described in detail with respect to specific embodiments thereof, it will be appreciated that those skilled in the art, upon attaining an understanding of the foregoing, may readily conceive of alterations to, variations of, and equivalents to these embodiments.

What is claimed is:

1. A painting device, said device comprising:

a first shaft, a second shaft attached to said first shaft and at an angle Θ to said first shaft, and a restraining knob which may be used to secure a paintbrush, and a brush and a threaded insert wherein said threaded insert is inserted into said brush, and wherein said second shaft is threaded over at least a portion of its length and said knob has internal threads which mate with said threaded portion of said second shaft and said threaded insert's threads, which are in a fixed relation to said brush, allow said insert to be screwed onto the threads of said second shaft such that said insert and thereby said brush can be pivoted.

2. The painting device of claim 1, wherein said knob can be rotated about said threads of said second shaft and said knob comes into contact with said brush such that said brush is placed into a fixed position and prevented from further rotation about said second shaft.

3. The painting device of claim 1, wherein said second shaft is inserted into said threaded insert, and said second shaft is on one side of said brush.

4. A brush holder adapted for use with a paintbrush having a hole therein, the holder comprising:

a coupler adapted to be attached to an extension pole;

a first shaft extending from the coupler;

a second shaft extending from the first shaft and defining an angle with respect thereto, a portion of the second shaft being threaded;

a restraining member pivotably attached to the second shaft, the restraining member adapted to move between a first position substantially parallel to the second shaft and a second position substantially perpendicular to the second shaft, the restraining member and second shaft being adapted to pass through the hole in the paintbrush when it is in the first position and restraining the paintbrush on the second shaft when in the second position, and a restraining knob provided with internal threads for engaging the threads on the second shaft and for securing the paintbrush on the holder.

* * * * *